US006708540B2

(12) United States Patent
Kawahara

(10) Patent No.: US 6,708,540 B2
(45) Date of Patent: Mar. 23, 2004

(54) MACHINE FOR SIMULTANEOUSLY CAULKING BOTH ENDS OF AN OBJECT

(75) Inventor: Hideshi Kawahara, Toyama (JP)

(73) Assignee: Tanaka Seimitsu Kogyo Co., Ltd., Toyoma (JP)

( * ) Notice: Subject to any disclaimer, the term of this patent is extended or adjusted under 35 U.S.C. 154(b) by 0 days.

(21) Appl. No.: 10/072,966

(22) Filed: Feb. 12, 2002

(65) Prior Publication Data

US 2002/0113094 A1 Aug. 22, 2002

(30) Foreign Application Priority Data

Feb. 13, 2001 (JP) ..... 2001-035269

(51) Int. Cl.[7] ..... B21D 39/00
(52) U.S. Cl. ..... 72/21.4; 72/407; 72/454
(58) Field of Search ..... 72/407, 454, 21.4; 29/509, 522.1, 243.5, 898.07

(56) References Cited

U.S. PATENT DOCUMENTS 1,874,457 A * 8/1932 Corey ..... 29/509
2,427,072 A * 9/1947 Rubin ..... 29/898.07
3,422,658 A * 1/1969 Michelson ..... 72/407
3,507,143 A * 4/1970 Georg ..... 72/407
3,512,476 A * 5/1970 Georg ..... 72/407
4,069,700 A * 1/1978 Bocharov et al. ..... 72/407
5,937,505 A * 8/1999 Strong et al. ..... 29/593
6,154,942 A * 12/2000 Toeniskoetter ..... 72/454

FOREIGN PATENT DOCUMENTS

JP 11-188435 7/1999

* cited by examiner

*Primary Examiner*—Daniel C. Crane
(74) *Attorney, Agent, or Firm*—Wenderoth, Lind & Ponack, L.L.P.

(57) ABSTRACT

A machine simultaneously caulks both axial ends of an object. The machine has an upper pressure plate having a first caulking punch mounted thereon is screwed to left and right ball threads at one side thereof, and a lower pressure plate having a second caulking punch mounted thereon screwed to the left and right ball threads at the other side thereof in such a way that the upper pressure plate and the lower pressure plate are moved relatively to each other along the same axis extending in a caulking direction.

12 Claims, 5 Drawing Sheets

MACHINE FOR SIMULTANEOUSLY CAULKING BOTH ENDS OF AN OBJECT

BACKGROUND OF THE INVENTION

1. Field of the Invention

The present invention relates to a machine for simultaneously caulking a periphery of both axial end surfaces (hereinafter referred to as both-end-caulking machine) of an object.

2. Description of the Related Art

The basic construction and mechanism of the both-end-caulking is known from Japanese Patent Application Laid-Open No.11-188435. However, the both-end-caulking machine has a pair of left and right ball threads (hereinafter simply referred to as left and right ball threads) and its constituent features are unknown.

In the both-end-caulking machine disclosed in Japanese Patent Application Laid-Open No. 11-188435, a lower caulking punch is stationary, whereas an upper caulking punch is moved downward to caulk both axial ends of a shaft. However, because the lower caulking punch is stationary, the shaft moves downward by a caulking amount required to caulk the lower axial end of the shaft at a caulking time and becomes eccentric. In a case where the upward and downward movement of the caulking punch is controlled by using an actuator, such as a hydraulic cylinder, it is difficult to finely adjust a caulking load and the caulking amount. Hence, it cannot be said that the both-end-caulking machine has a high processing precision. Another problem of the both-end-caulking machine is that the use of the hydraulic cylinder causes the both-end-caulking machine to be large and thus a wide installing space is required.

SUMMARY OF THE INVENTION

The present invention has been made in view of the above-described situation. Accordingly, it is an object of the present invention to provide a both-end-caulking machine capable of solving the above-described problems and accomplishing a caulking process efficiently.

To achieve the object, the present inventors have made an energetic investigation and found that the problems of the conventional art can be solved by a machine for simultaneously caulking both axial ends of an object, in which an upper pressure plate having a first caulking punch mounted thereon is screwed to one side of left and right ball threads, and a lower pressure plate having a second caulking punch mounted thereon is screwed to the other side of the left and right ball threads, in such a way that the upper pressure plate and the lower pressure plate are moved relative to each other in a direction parallel to a caulking direction. In this regard, please refer to FIG. 5.

The present inventors have also found that fine adjustment of a caulking load and a caulking amount can be accomplished by using a servo motor which electrically controls an operation of moving the upper pressure plate and the lower pressure plate relative to each other. It is possible to make the caulking machine compact by utilizing the servo motor in operating the caulking machine.

The present inventors have made further study and examination, and completed the present invention.

Accordingly, the present invention relates to the following.

(1) A machine for simultaneously caulking both axial ends of an object, in which an upper pressure plate having a first caulking punch mounted thereon is screwed to one side of left and right ball threads, and a lower pressure plate having a second caulking punch mounted thereon is screwed to the other side of the left and right ball threads, in such a way that the upper pressure plate and the lower pressure plate are moved relative to each other in a direction parallel to a caulking direction such that the object is caulked.

(2) A machine according to above (1), wherein the left and right ball threads have the same pitch.

(3) A machine according to above (1) or (2), wherein the number of the left and right ball threads provided for one caulking machine is two.

(4) A machine according to any one of above (1) through (3), wherein a servo motor electrically controls an operation of moving the upper pressure plate and the lower pressure plate relative to each other.

(5) A machine according to any one of above (1) through (4), wherein whether a periphery of both axial end surfaces of the object has been normally caulked is automatically determined based on a caulking load and a caulking amount obtained at a caulking time.

BRIEF DESCRIPTION OF THE DRAWINGS

FIG. 4(*a*) is a sectional view showing a state in which each of a caulking projection 15*a* and a caulking projection 16*a* touches each end surface of the object to be caulked into a roller shaft 13 just before the caulking punches P1 and P2 begin to move for caulking.

FIG. 4(*b*) is a sectional view showing a state in which the movement of the caulking punches P1 and P2 for caulking has just stopped and the object is firmly connected to a supporting wall 10*b* to form the roller shaft 13, through caulking.

DETAILED DESCRIPTION OF THE PREFERRED EMBODIMENTS

The embodiments of the present invention will be described below with reference to the accompanying drawings.

Figure 1:
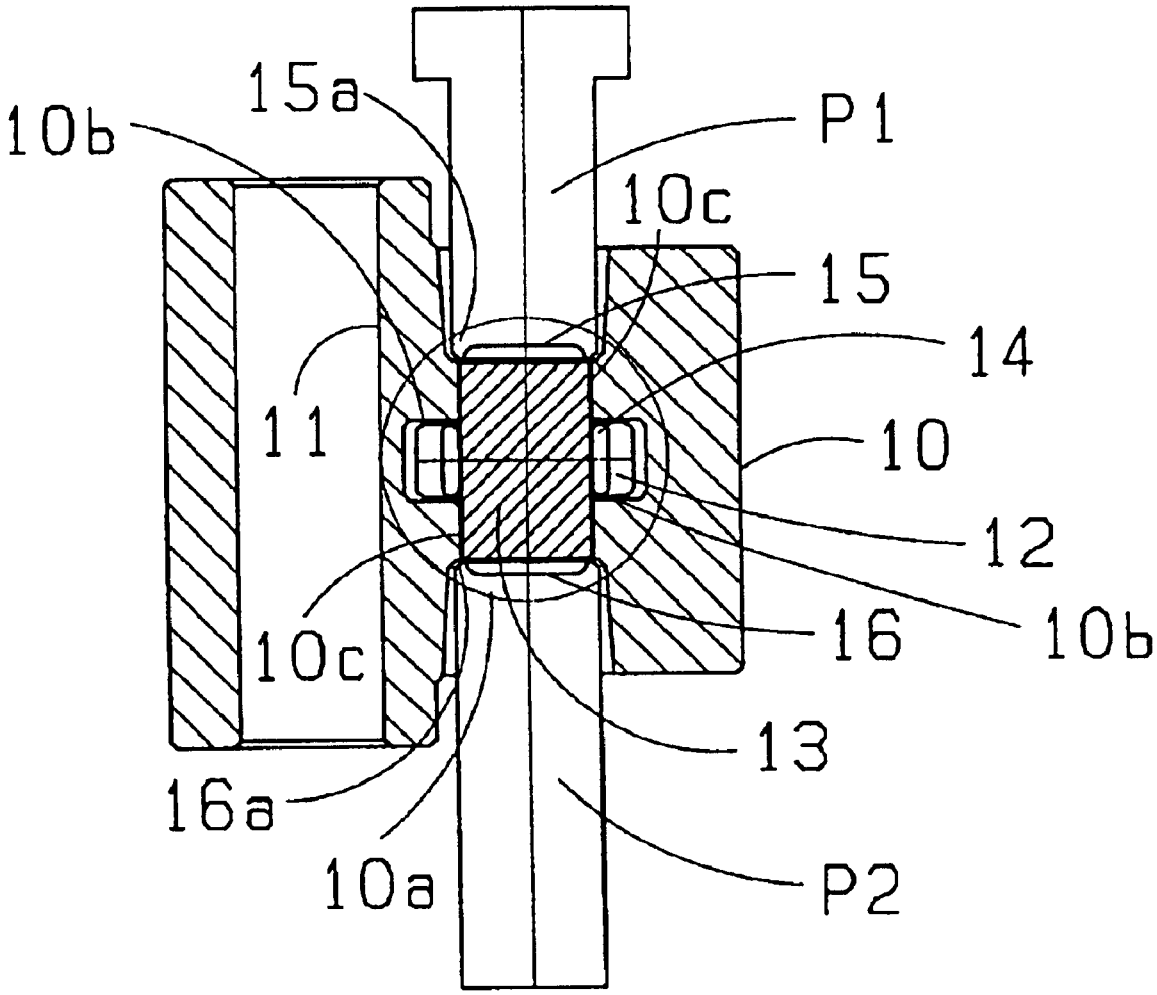
FIG. 1 is a partly enlarged view of a part 50 indicated in FIG. 3, showing a state in which a caulking projection of each of a pair of caulking punches is in contact with both axial end surfaces of an object to be caulked.
Figure 2:
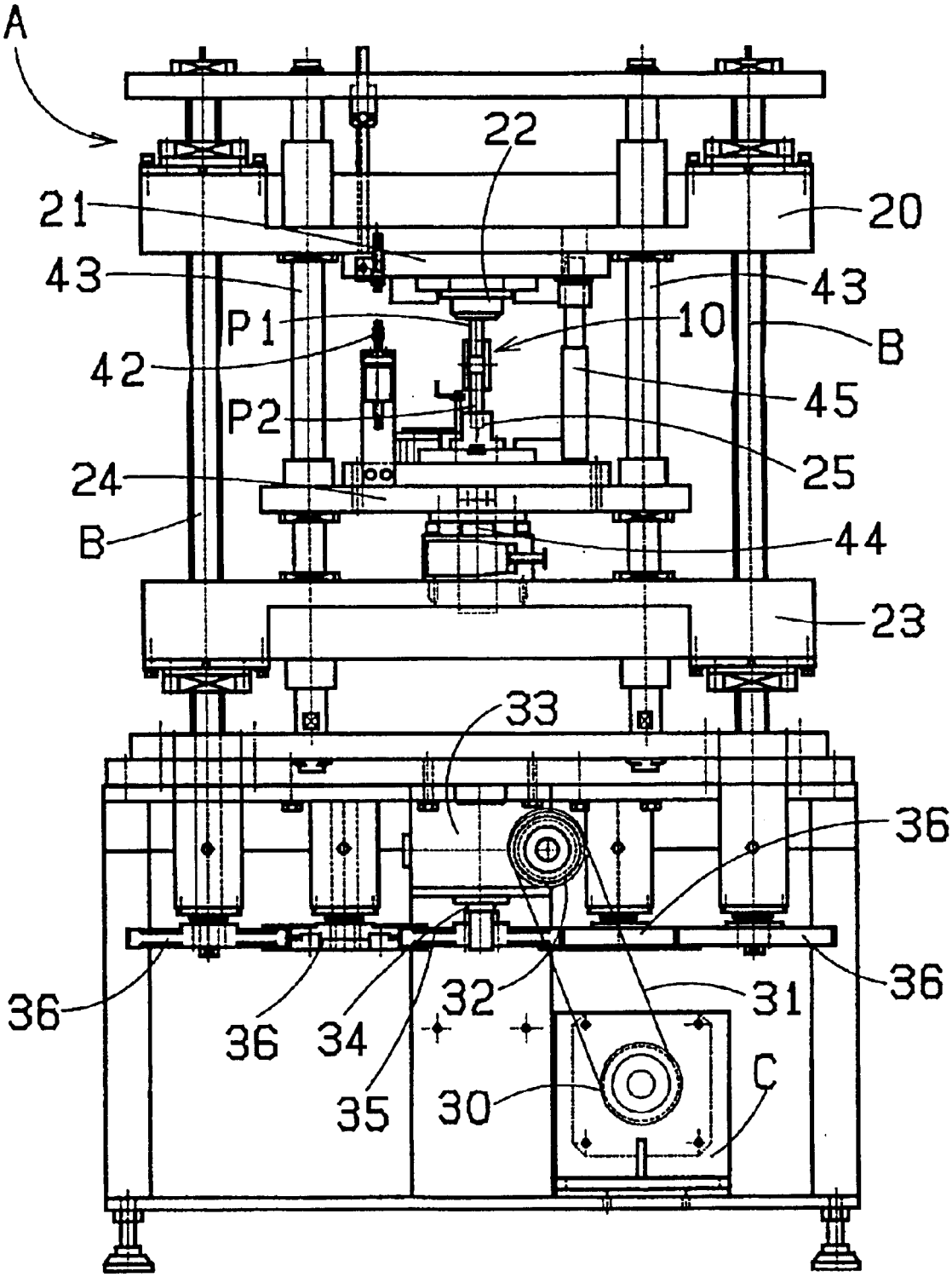
FIG. 2 is a front view of a both-end-caulking machine of the present invention.
Figure 3:
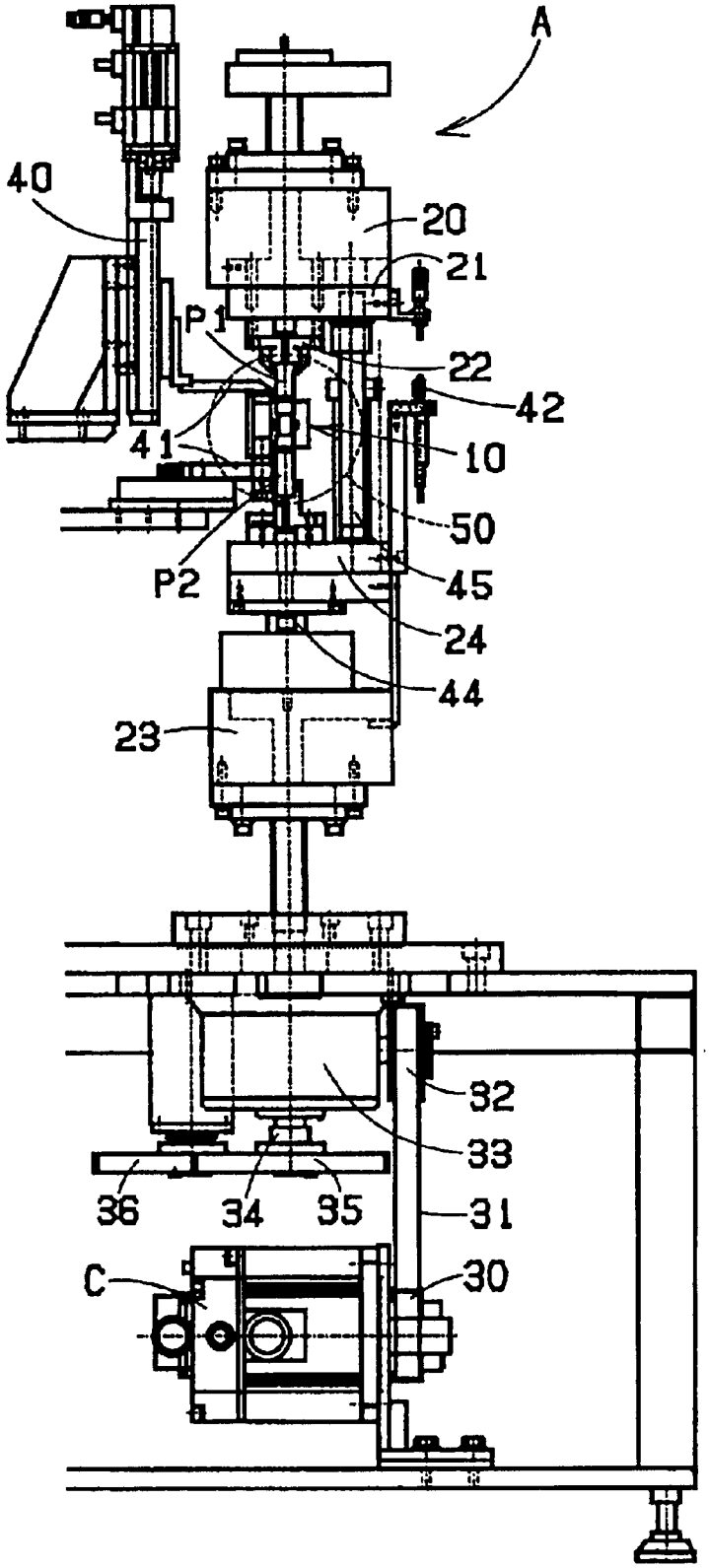
FIG. 3 is a left side view of FIG. 2.

FIGS. 1 through 3 show the preferred embodiment of the present invention. FIG. 1 is a partly enlarged view of a part 50 indicated in FIG. 3, showing a state in which a caulking projection of each of a pair of caulking punches is in contact with both axial end surfaces of an object to be caulked. FIG. 2 is a front view of a both-end-caulking machine of the present invention. FIG. 3 is a left side view of FIG. 2.

Referring to FIG. 1, products to be caulked include a rocker arm incorporated in a valve-operating apparatus of an unshown internal combustion engine that functions to open and close an operating valve in unison with a rotation of a valve-operating cam. A body 10 of a rocker arm has a shaft hole 11 formed therein. The shaft hole 11 communicates with a shaft supporting the body 10 pivotally. A portion for supporting a roller 12 in contact with the valve-operating cam is formed at a center 10*a* of the body 10. The roller-supporting portion is constructed of a pair of supporting walls 10*b* confronting each other, with the supporting walls 10*b* sandwiching the roller 12 therebetween. Each supporting wall 10*b* has a supporting hole 10*c* supporting both axial ends of a to-be-caulked roller shaft 13(O), with both axial ends of the roller shaft 13 fitted into the supporting holes 10*c*.

The roller shaft 13 constitutes the to-be-caulked object of the present invention. The roller 12 is rotatably supported by the roller shaft 13 at an intermediate portion thereof through a needle 14, with the roller 12 fitted on the intermediate portion of the needle 14. A periphery of both axial ends of the roller shaft 13 is caulked to a periphery of each of the supporting holes 10*c* of the body 10 of the rocker arm. The caulking process is carried out by using a both-end-caulking machine A which is described below.

With reference to FIGS. 1 through 3, the both-end-caulking machine A has a first caulking punch P1 for caulking one axial end surface of the roller shaft 13 and a second caulking punch P2 for caulking the other axial end surface of the roller shaft 13. The first caulking punch P1 and the second caulking punch P2 are movable relative to each other along the same axis (axial direction of the roller shaft 13) extending in a roller shaft-caulking direction. A portion of the first caulking punch P1 is fitted into an upper base 22 fixed to a position located below an upper fixing frame 21 mounted on an upper pressure plate 20 of the both-end-caulking machine A. A caulking projection 15*a* is circumferentially formed in integration with a front (lower) end surface of a front (lower) portion 15 of the first caulking punch P1. A portion of the second caulking punch P2 is fitted into a lower base 25 fixed to a position located above a lower fixing frame 24 mounted on a lower pressure plate 23 of the both-end-caulking machine A. A caulking projection 16*a* is circumferentially formed in integration with a front (upper) end surface of a front (upper) portion 16 of the second caulking punch P2. The first caulking punch P1 and the second caulking punch P2 are disposed along the same axis extending in the vertical caulking direction. The upper pressure plate 20 and the lower pressure plate 23 are movable relative to each other along the same axis through left and right ball threads B opposite to each other in the thread direction thereof.

Figure 5:
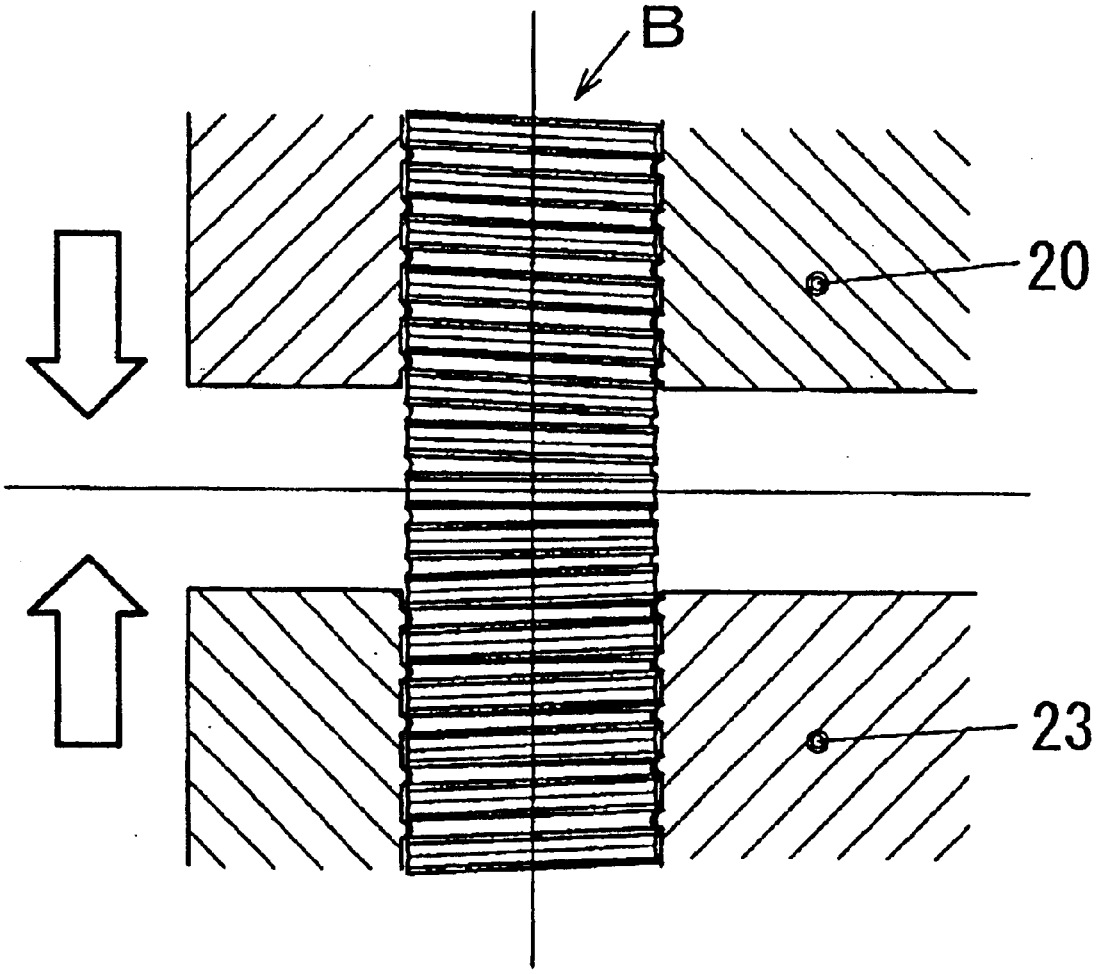
FIG. 5 is a sectional view showing a relationship of left and right ball threads, a upper pressure plate 20 and a lower pressure plate 23, and the two arrows showing the movement of the two pressure plates when a load is applied for caulking.

FIG. 5 is a sectional view showing the relationship of the left and right ball threads, the upper pressure plate 20 and the lower pressure plate 23, and the two arrows show the movement of the two pressure plates when the load is applied for caulking. The thread directions are opposite each other, and the border of the adverse direction is shown by the horizontal line in FIG. 5.

As described above, each of the left and right ball threads B consists of a known ball thread, but is so formed that the thread direction of the left ball thread and that of the right ball thread are opposite to each other. In the embodiment, to facilitate control of caulking process, the left and right ball threads B have the same pitch and two left and two right ball threads B are provided for one both-end-caulking machine A.

In the both-end-caulking machine having the above-described mechanism, when the upper pressure plate 20 is moved downward owing to a rotation of the left and right ball threads B in one direction caused by the actuation of a servo motor C, the lower pressure plate 23 is moved upward. This is because the thread direction of the left ball thread and that of the right ball thread are opposite to each other. When the upper pressure plate 20 is moved upward owing to the rotation of the left and right ball threads B in the opposite direction caused by the actuation of the servo motor C, the lower pressure plate 23 is moved downward.

Since the first caulking punch P1 and the second caulking punch P2 are fitted on the upper base 22 and the lower base 25, respectively, the first caulking punch P1 and the second caulking punch P2 are movable relative to each other along the same axis extending in the roller shaft-caulking direction. That is, the first caulking punch P1 and the second caulking punch P2 are capable of caulking upper and lower ends of the roller shaft 13 simultaneously, respectively.

An example of the process of caulking both axial ends of the roller shaft 13 by using the both-end-caulking machine A is briefly described below.

A power outputted from the servo motor C as a result of its rotation is transmitted to a pulley belt 31 through an output-side pulley 30 and inputted to an input-side pulley 32. A reduction gear 33 adjusts the power inputted to the input-side pulley 32 to an appropriate number of rotations. The left and right ball threads B coupled to drive gears 36, respectively, are rotated on their axes through a driving gear 35 coupled to an output shaft mounted on the reduction gear 33. In a case where two or more left and right ball threads B are provided for one both-end-caulking machine A, it is conceivable that one servo motor C is provided for one left and right ball threads B. However, the provision of a plurality of the servo motors C for one both-end-caulking machine A is unfavorable in view of the running cost and caulking precision. Thus in the embodiment, the power for one both-end-caulking machine A is controlled by one servo motor C.

Accordingly, the upper pressure plate 20 and the lower pressure plate 23 screwed to the left and right ball threads B are moved, each in the adverse direction, relative to each other along the thread direction of the left and right ball threads B by the left and right ball threads B rotating in the same direction. That is, the first caulking punch P1 and the second caulking punch P2 mounted on the upper pressure plate 20 and the lower pressure plate 23, respectively, are moved upward and downward relative to each other in the axial direction of the roller shaft 13. Therefore, both axial ends of the roller shaft 13 can be caulked simultaneously.

To caulk both axial ends of the roller shaft 13 simultaneously by the both-end-caulking machine A, the body 10 of the rocker arm is installed at a predetermined position of the both-end-caulking machine A. To this end, it is preferable to insert an insertion jig 41 of a positioning apparatus 40 installed on the both-end-caulking machine A into the shaft hole 11. In addition to the embodiment, products to be caulked can be installed on the predetermined position of the both-end-caulking machine A by using known arts.

In the embodiment, to accomplish a preferable caulking process, the servo motor C is used. Owing to electric control of the servo motor C, a caulking amount is prevented from becoming nonuniform and the axis of a to-be-caulked object is prevented from becoming eccentric, when both axial ends of the to-be-caulked object are caulked simultaneously. That is, until a front (lower) end of a position determining sensor 42 provided on the upper pressure plate 20 and a front (upper) end of the position determining sensor 42 provided on the lower pressure plate 23 contact each other, the upper pressure plate 20 and the lower pressure plate 23 are simultaneously moved at a high speed relative to each other. Thereafter, each of the caulking projection 15*a* of the first caulking punch P1 and the caulking projection 16*a* of the second caulking punch P2 contacts the axial upper end and the axial lower end of the object to become the roller shaft 13, respectively, and a certain initial load is applied to the object to be the roller shaft 13.

Figure 4A:
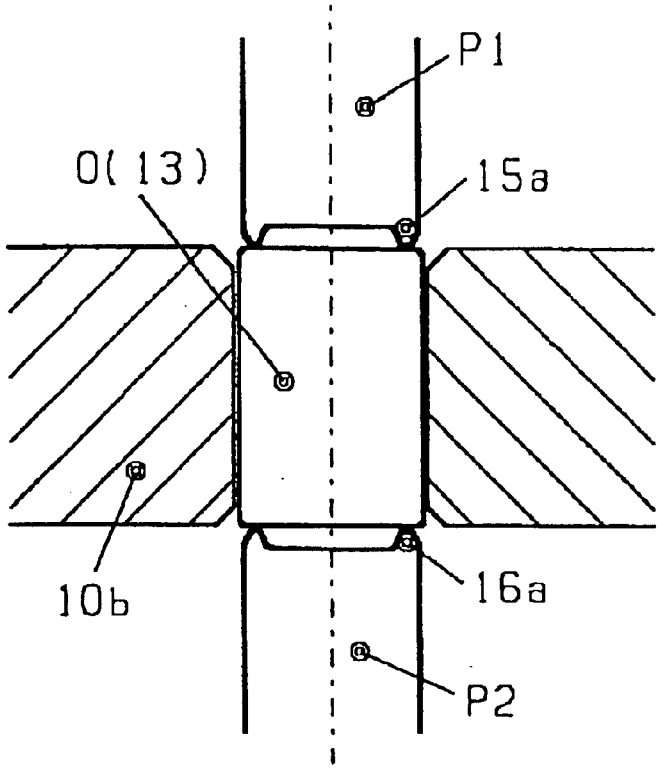
FIG. 4(*a*), FIG. 4(*b*) and FIG. 5 are model figures which are different in detail from FIG. 1, FIG. 2 and FIG. 3 showing the preferred embodiment of the machine of the present invention, but which make easy to understand the function of the preferred embodiment.
Figure 4B:
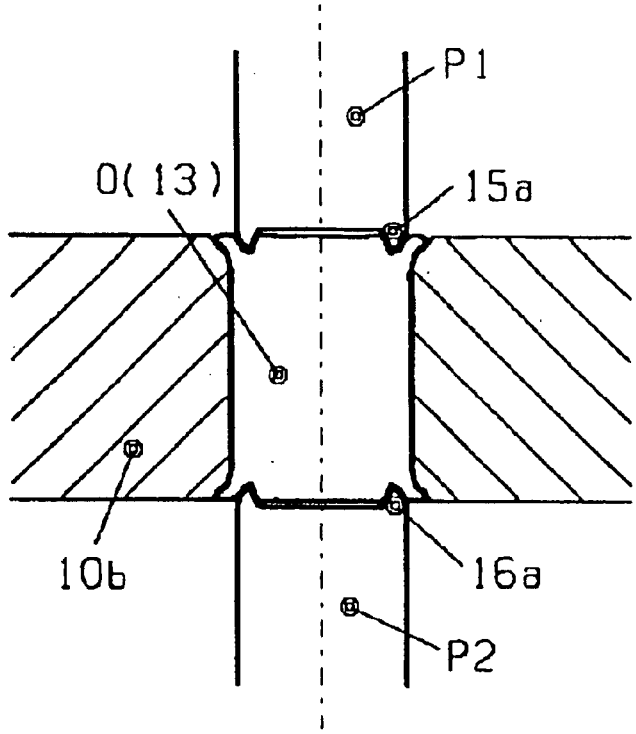

FIG. 4(*a*) is a sectional view showing a state in which each of the caulking projection 15*a* and the caulking projection 16*a* touches each end surface of the object to be caulked into the roller shaft 13 just before the caulking punches P1 and P2 begin to move for caulking.

FIG. 4(*b*) is a sectional view showing a state in which the movement of the caulking punches P1 and P2 for caulking has just stopped and the object is firmly connected to supporting wall 10*b* to form the roller shaft 13, through caulking.

Thereafter, the first caulking punch P1 and the second caulking punch P2 move forward at a low speed by a predetermined caulking amount set on the position determining sensor 42, thus performing the caulking process. Thereafter, both caulking punches P1 and P2 move backward at a high speed until the predetermined caulking stroke.

A guide 43 is provided on the lower pressure plate 23 to restrict the movement direction of the lower fixing frame 24 set on a load cell 44 to the direction in which the upper pressure plate 20 and the lower pressure plate 23 move relative to each other. Based on an output by the load cell 44, obtained at the time of the caulking process, a caulking load is controlled.

A limit device 45 is provided inside the both-end-caulking machine A to stop the servo motor C instantaneously, if the caulking load overruns. Thereby, it is possible to prevent the both-end-caulking machine A from being mechanically damaged.

It is difficult for the conventional art using an actuator such as a hydraulic cylinder to make fine adjustments to the caulking amount and the caulking load. However, fine adjustment of the caulking amount and the caulking load can be accomplished more easily and reliably by the electric control which is made by the servo motor C. Thereby, the caulking processing can be achieved with higher precision.

The present invention is not limited to the above-described embodiment and can be embodied within the scope thereof. In the description of the above-described embodiment, the apparatus and method for caulking the axial end surface of the roller shaft of the rocker arm have been shown. In addition to the rocker arm, it is possible to caulk mechanical parts whose axial ends are required to be caulked to supporting members, respectively.

According to the present invention, the caulking process can be accomplished with high precision and efficiency by the machine for simultaneously caulking both axial ends of an object. The upper pressure plate having the first caulking punch mounted thereon is screwed to the left and right ball threads at one side of the left and right ball threads, and the lower pressure plate having the second caulking punch mounted thereon is screwed to the left and right ball threads at the other side of the left and right ball threads, in such a way that the upper pressure plate and the lower pressure plate are moved relative to each other along the same axis extending in a caulking direction.

What is claimed is:

1. An apparatus for simultaneously caulking both axial ends of an object, said apparatus comprising:

a pair of ball threads having a first side threaded in a first direction and a second side threaded in a second direction opposite to the first direction;

a motor operable to rotate said pair of ball threads;

an upper pressure plate having a first caulking punch mounted thereon, said upper pressure plate being screwed to said first side of said pair of ball threads; and a lower pressure plate having a second caulking punch mounted thereon, said lower pressure plate being screwed to said second side of said pair of ball threads, wherein said upper pressure plate and said lower pressure plate move in opposite directions parallel to a caulking direction when said motor rotates said pair of ball threads.

2. An apparatus according to claim 1, wherein said pair of ball threads have a same pitch.

3. An apparatus according to claim 1, further comprising a second pair of ball threads to which said upper pressure plate and said lower pressure plate are screwed.

4. An apparatus according to claim 1, wherein said motor is a servo motor.

5. An apparatus according to claim 1, wherein whether a periphery of both of the axial end surfaces of the object has been normally caulked is automatically determined based on a caulking load and a caulking amount obtained at a caulking time.

6. An apparatus according to claim 2, further comprising a second pair of ball threads to which said upper pressure plate and said lower pressure plate are screwed.

7. An apparatus according to claim 2, wherein said motor is a servo motor.

8. An apparatus according to claim 3, wherein said motor is a servo motor.

9. An apparatus according to claim 2, wherein whether a periphery of both of the axial end surfaces of the object has been normally caulked is automatically determined based on a caulking load and a caulking amount obtained at a caulking time.

10. An apparatus according to claim 3, wherein whether a periphery of both of the axial end surfaces of the object has been normally caulked is automatically determined based on a caulking load and a caulking amount obtained at a caulking time.

11. An apparatus according to claim 4, wherein whether a periphery of both of the axial end surfaces of the object has been normally caulked is automatically determined based on a caulking load and a caulking amount obtained at a caulking time.

12. An apparatus according to claim 1, further comprising a sensor operable to determine a position of said upper pressure plate with respect to said lower pressure plate.

* * * * *